FTP8011 OR 4,192,379

United States Patent [19]

Kennedy, Jr.

[11] 4,192,379

[45] Mar. 11, 1980

[54] BLOWOUT PREVENTER AND METHOD OF INSURING PREVENTION OF FLUID LEAKS OUT OF A WELLHEAD

[76] Inventor: Alvin B. Kennedy, Jr., P.O. Box 897, Alvin, Tex. 77511

[21] Appl. No.: 917,916

[22] Filed: Jun. 22, 1978

Related U.S. Application Data

[63] Continuation-in-part of Ser. No. 854,193, Nov. 23, 1977, abandoned.

[51] Int. Cl.[2] ..... E21B 33/06

[52] U.S. Cl. ..... 166/250; 166/88; 166/90; 251/1 A; 251/1 B; 285/10

[58] Field of Search ..... 166/75 R, 90, 86, 88, 166/285, 250; 251/1 R, 1 A, 1 B; 137/246, 246.22; 285/10, 11

[56] References Cited

U.S. PATENT DOCUMENTS

| | | | |
|---|---|---|---|
| 2,079,922 | 5/1937 | Owen | 166/84 |
| 2,177,164 | 10/1939 | Baash | 277/34.3 |
| 2,552,901 | 5/1951 | Miller | 166/86 X |
| 3,272,222 | 9/1966 | Allen | 251/1 A |
| 3,277,964 | 10/1966 | Houpeurt et al. | 166/90 X |
| 3,521,856 | 7/1970 | Smith | 137/246.22 X |
| 3,926,256 | 12/1975 | McCall | 251/1 R X |
| 4,071,085 | 1/1978 | Grable et al. | 166/88 X |

*Primary Examiner*—Stephen J. Novosad
*Attorney, Agent, or Firm*—Guy E. Matthews

[57] ABSTRACT

A method of and apparatus for preventing fluid leaks out of a well which involves installing a blowout preventer at a wellhead, the preventer has a body with a bore communicating with a bore hole and a clamping means for controlling the passage of fluid through the bore. Means are provided for directing sealant into the bore beneath the clamping means so that when an occurrence of a blowout is sensed, the clamping means are closed to inhibit flow of fluid up the bore and a sealant is injected through the directing means into the bore so that the sealant is carried to the closed clamping means which forms a seal to insure that fluid does not leak past the closed clamping means.

29 Claims, 6 Drawing Figures

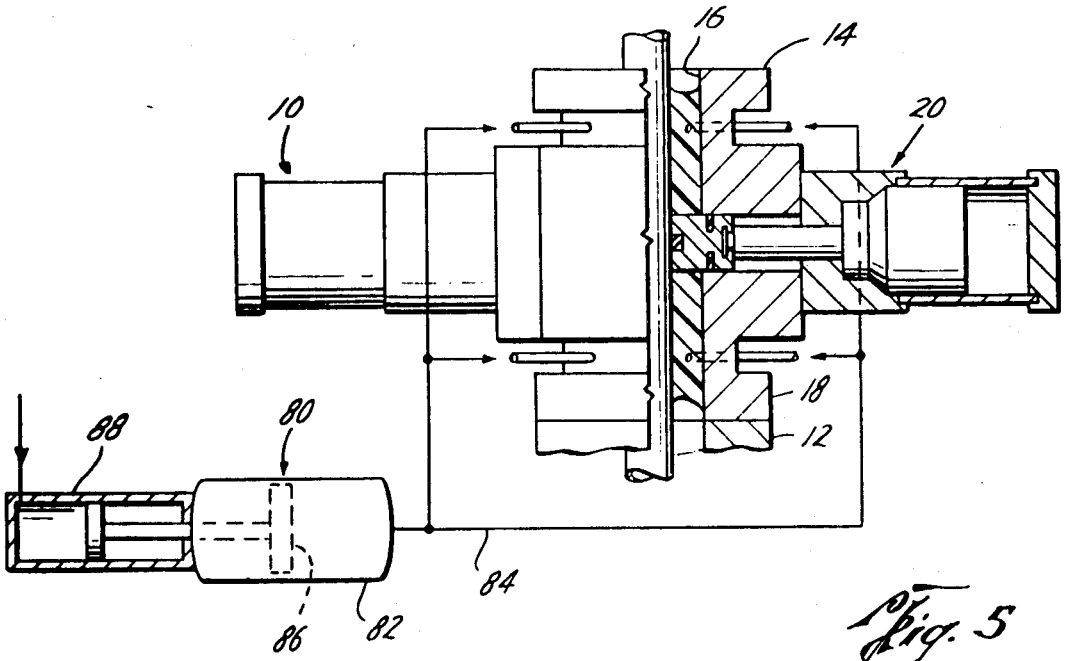
Fig. 5
Fig. 3
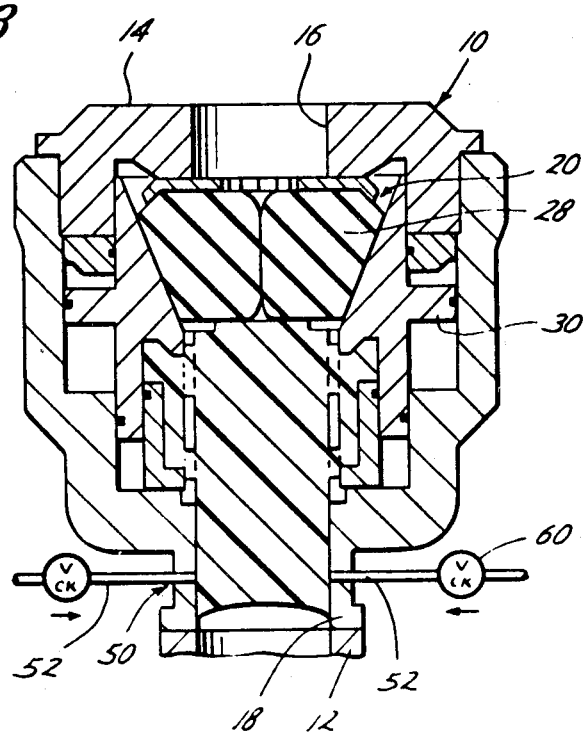

BLOWOUT PREVENTER AND METHOD OF INSURING PREVENTION OF FLUID LEAKS OUT OF A WELLHEAD

CROSS REFERENCES TO RELATED APPLICATIONS

This application is a continuation-in-part of application Ser. No. 854,193, filed Nov. 23, 1977, and entitled "Blowout Preventer and Method of Insuring Prevention of Fluid Leaks Out of a Wellhead", now abandoned.

BRIEF SUMMARY OF THE INVENTION

It is well known in the well drilling industry to use blowout preventers at the wellhead to control pressures in the open space between the casing and drill pipe or in an open hole during drilling and completion operations. A conventional blowout preventer includes a body with a bore for communicating with a bore hole of a well; means are mounted with the body for coupling the body to the wellhead which puts the bore in communication with the bore hole and a clamping means are mounted with the body to seal the fluid pressure within the bore hole by moving from an open to a closed position. These clamping means may include opposing rams to form a ram-type blowout preventer or annular packing members to form an annular type blowout preventer. Further, in the ram-type blowout preventer, the opposing rams may be designed to clamp around a drill string or casing or may be bind rams for engaging each other.

It has recently been discovered that such blowout preventers occasionally do not succeed in preventing fluids from leaking into the surrounding environment, the atmosphere, or water. Such leakages cause losses of valuable fluids, such as drilling mud, as well as polluting the environment. Frequently, this leakage is around the clamping means of the blowout preventer which may occur for many reasons, such as improperly designed clamps and misaligned apparatus extending through the bore of the blowout preventer. Further, this leakage may be caused by the blowout preventer having been installed upside down at the wellhead.

Accordingly, it is a primary object of the present invention to provide a method of insuring the prevention of fluid leaks out of a well.

Further, it is an object of the present invention to provide a method of insuring the prevention of fluid leaks out of the well even though a blowout preventer is installed upside down at the wellhead.

Further, it is an object of the present invention to provide a blowout preventer, wellhead assembly and spool for use at a wellhead which prevents fluid leaks out of the well.

Further, it is an object of the present invention to provide a blowout preventer, wellhead assembly and spool for use at a wellhead which prevents fluid leaks out of the well even though the preventer is installed upside down.

In accordance with the invention, a method of insuring the prevention of fluid leaks out of a well is disclosed. The method includes installing a blowout preventer at the wellhead, such blowout preventer including a body with a bore for communicating with the bore hole of a well, means mounted with the body for coupling said body to the wellhead and clamping means mounted with the body for controlling the passage of fluid through the bore by moving from an opened position to a closed position. Means are also provided for directing sealant into the bore below the clamping means so that a sealant injected through the directing means is carried by fluids flowing up the bore. When a blowout is sensed, the clamping means are closed to inhibit the flow of fluid up the bore and the sealant is injected through the directing means into the bore so that the sealant is carried by leaking fluid up the bore to the clamping means and form a seal to insure that fluid does not continue to leak past the closed clamping means.

BRIEF DESCRIPTION OF THE DRAWINGS

Other objects and advantages of the invention will become apparent upon reading the following detailed description and upon reference to the drawings, in which like reference numerals are used throughout the drawings to designate like parts:

FIG. 3 is a side elevational view, partly in section, of a wellhead assembly using an annular-type blowout preventer constructed according to the present invention installed at a wellhead.

FIG. 5 is a side elevational view, partly in section, of a wellhead assembly using a blowout preventer constructed according to the present invention with a control means for injecting sealant into sealant passageways.

While the invention will be described in connection with exemplary embodiments and procedures, it will be understood that it is not intended to limit the invention to those embodiments and procedures. On the contrary, it is intended to cover all alternatives, modifications and equivalents as may be included within the spirit and scope of the invention as defined by the appended claims.

DETAILED DESCRIPTION OF THE INVENTION

Figure 1:
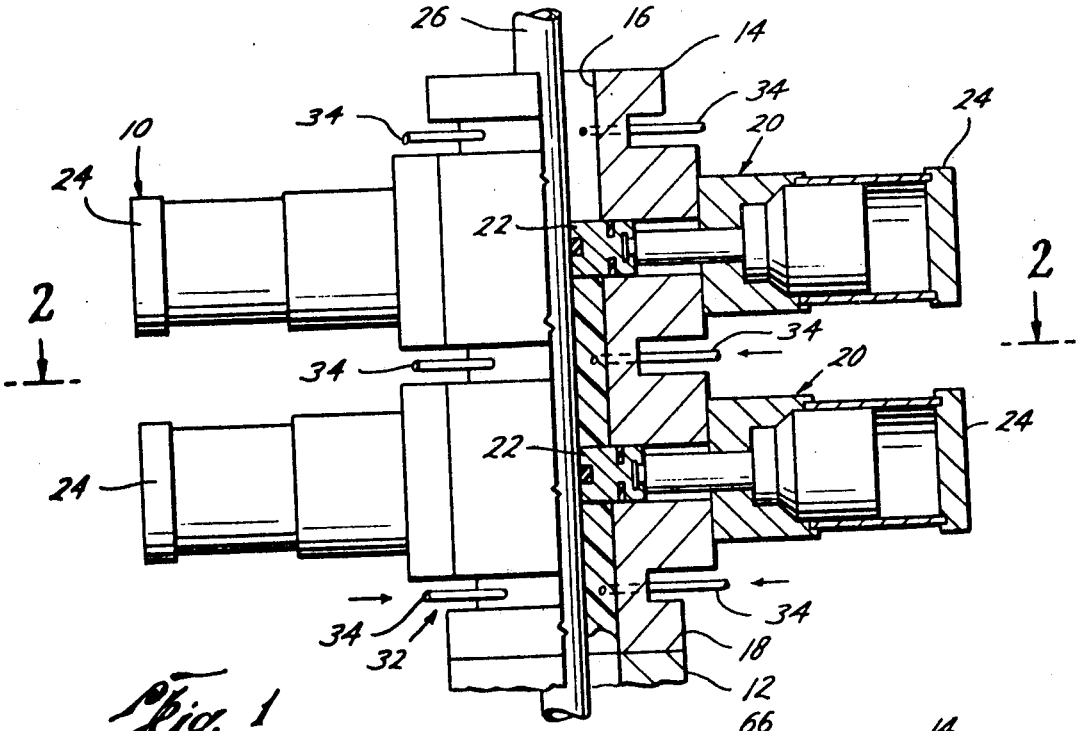
FIG. 1 is a side elevational view, partly in section, of a wellhead assembly using a ram-type blowout preventer constructed according to the present invention installed at a wellhead.
Figure 2:
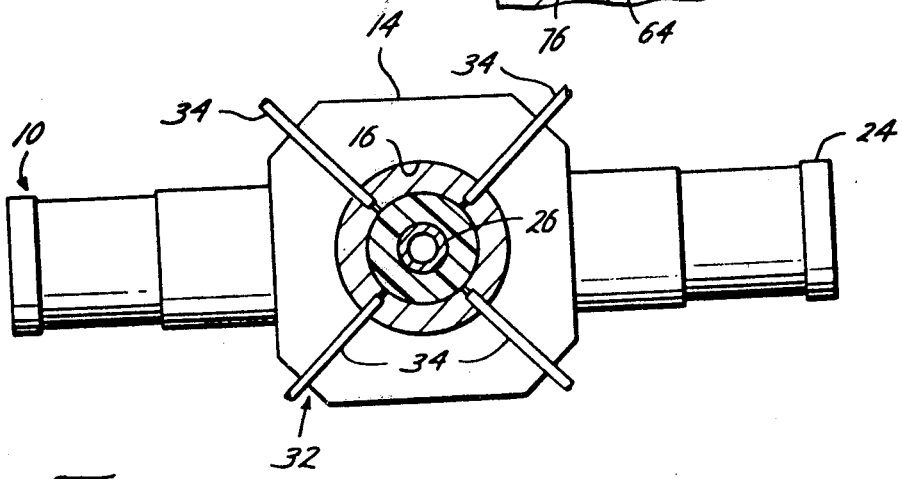
FIG. 2 is a plan view, partly in section, taken in the direction of arrows 2—2 of the embodiment of the invention shown in FIG. 1.

Turning now to FIGS. 1–3 and 5, a wellhead assembly which includes a blowout preventer 10, constructed according to the present invention, is shown mounted at a wellhead 12. Blowout preventer 10 has a body 14 with a bore 16 extending therethrough for communicating with the bore hole of a well. Mounted with body 14 is a conventional mechanism 18 for coupling the body onto the wellhead and placing bore 16 in communication with the bore hole. A clamping means 20 is mounted with body 14 for controlling the passage of fluid through bore 16 by moving from an opened position to a closed position to seal the fluid pressure within the bore hole, the closed position being illustrated in the figures. The blowout preventer shown in FIGS. 1, 2, and 5, is a ram-type and includes opposed mechanical rams 22 moved by hydraulic pistons 24. Although rams 22 are shown clamping around a drill string 26, the rams may be blind rams. The blowout preventer shown in FIG. 3 is an annular-type and includes annular packing members 28 moved by hydraulic pistons 30. In both blowout preventers, clamping means 20 are moved from the opened position to the closed position by supplying hydraulic pressure to the pistons in response to a blowout being sensed in the well by conventional apparatus (not shown).

Apparatus 32 is mounted with body 14 for directing sealant into bore 16 above wellhead 12 and below clamping means 20. Thus, a sealant injected through apparatus 32 is carried by fluids flowing up bore 16 to clamping means 20 which forms a seal when the clamping means are closed and thereby insures that fluid does not leak past the closed clamping means and out of the well. Preferably, the sealant directing means includes a sealant passageway 34 with an outlet disposed above the wellhead and below the clamping means, which permits the sealant to flow through the body into the bore. To provide a uniform sealant flow around and out bore 16, directing means 32 may be a plurality of passageways 34, such as shown in the drawings. In the ram-type blowout preventer shown in FIGS. 1, 2 and 5, four passageways are preferred with the outlet of each passageway disposed on either side of and in relative close proximity to the clamping means. Most preferred, apparatus 32 is disposed on the body above as well as below the clamping means to insure that sealant is injected on the wellhead side of the clamping means in the event that the blowout preventer is installed at the wellhead upside down.

Figure 4:
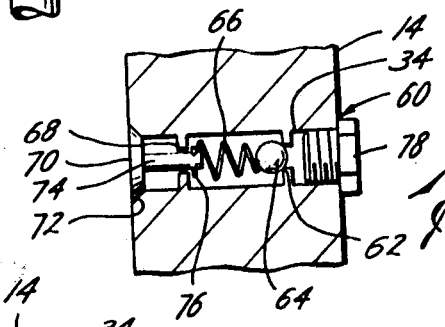
FIG. 4 is an enlarged side elevational view, partly in section, of a valve means used in the present invention which prevents fluid from flowing out through a sealant passageway while permitting sealant to flow into the bore.

Since it is undersirable to permit fluid to flow out through sealant passageways 34 because of the loss of the fluid and the contamination of the environment, a valve means 60 are mounted with body 14 to prevent fluids from flowing out through the sealant passage while permitting sealant to be injected into bore 16. Although any valve means 60 disposed in fluid communication with each passage 34 (as by pipes 52 shown in FIG. 3) may be used, it is preferred that a check valve be disposed within each passage 34 of body 14. As shown in FIG. 4, such check valve includes a shoulder 62 with a seating surface, movable element 64 for mating with the seating surface and a spring 66 acting against a ledge 68 to urge element 64 into engagement with the seating surface. A plug 70 may also be disposed on the bore side of each passage 34 to prevent fluid from flowing into the passage and possibly interfering in the proper functioning of the check valves. Preferably, plug 70 has beveled edges 72 engaging a matching shoulder provided on the body around each passage 34 and a rod 74 extending from plug 70 through ledge 68. A shear pin 76 extends through rod 74 for engaging ledge 68. Thus, as sealant is injected through passage 34 and moves past check valve 60, pressure increases against plug 70 until shear pin 74 breaks, which permits movement of plug 70 out of passage 34 and sealant moves into the bore. Moreover, a bolt 78 may be threadedly mounted within sealant passage 34 to plug sealant passage 34 and prevent any flow therethrough.

As shown in FIG. 5, a sealant supply means 80 is mounted with said body for injecting sealant through sealant passageways 34 into bore 16. Supply means 80 preferably has a cannister 82 supporting a quantity of sealant. The sealant is forced through conduits 84 to each passageway 34 by using a piston 86, which is moved by a control mechanism so that the sealant may be injected from a remote location. The control mechanism uses hydraulic fluid through line 87 to move a hydraulic piston 88 connected to piston 86. Thus, the supply means 80 and control mechanism may be installed on a blowout preventer at a submerged wellhead for activation from a vessel should the well blow out.

Figure 6:
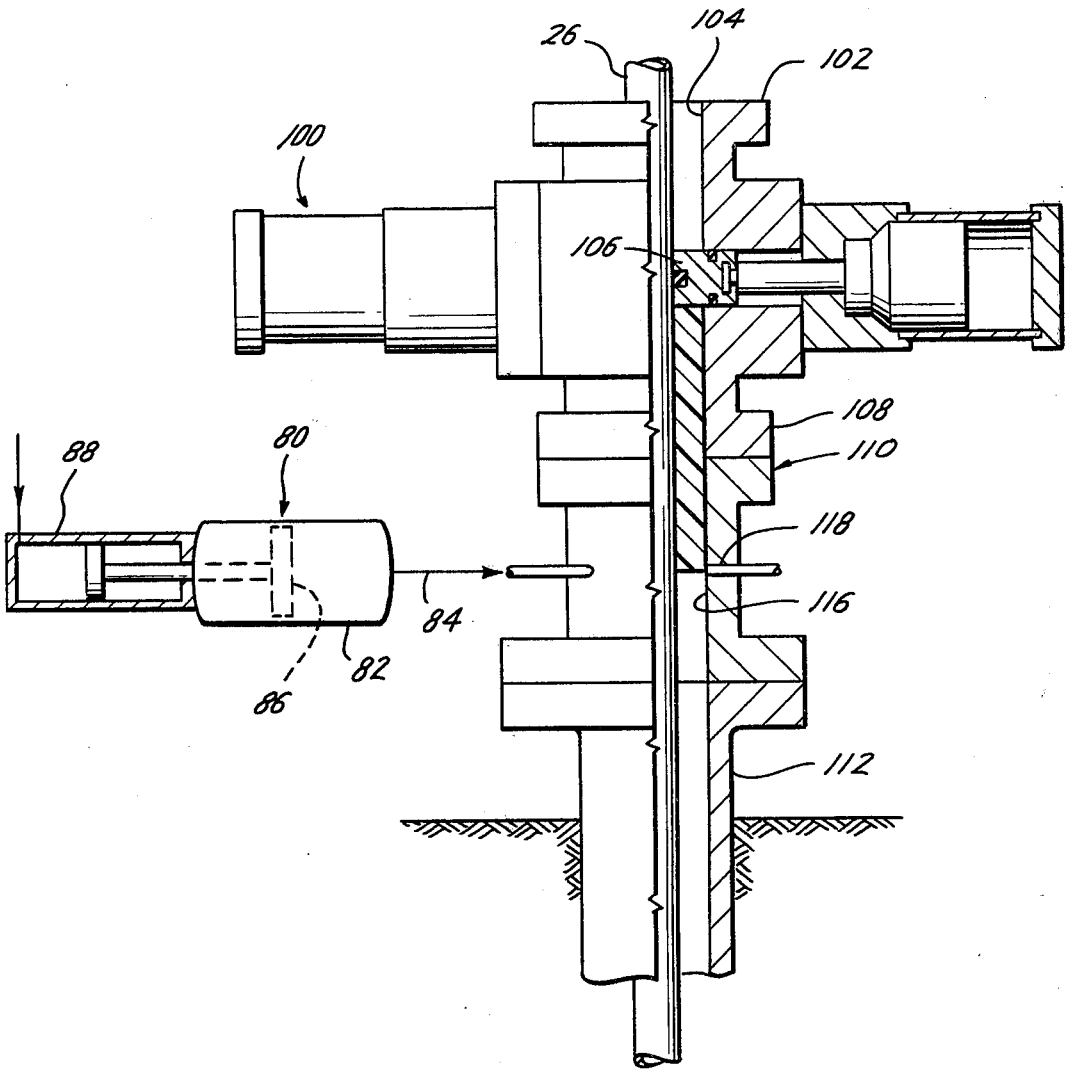
FIG. 6 is a side elevational view, partly in section, of a wellhead assembly using a spool constructed according to the present invention.

The wellhead assembly shown in FIG. 6 includes a conventional blowout preventer 100 having a body 102 with a bore 104 extending therethrough for communicating with the bore hole in a well. A clamping means 106 is mounted with body 102 for controlling the passage of fluid through bore 104 by moving from an opened to the closed position shown to seal the fluid pressure within the bore hole. Although clamping means 106 are shown as opposing rams, it is to be understood that this invention will work equally well for the annular type blowout preventer. Mounted with body 102 is a conventional mechanism 108 for coupling the body to a portion of the wellhead assembly, specifically to a casing spool 110 mounted on casing pipe 112 beneath the blowout preventer. Casing spool 110 includes a body 114 with a bore 116 extending therethrough for communicating with the bore hole in the well and bore 104 in blowout preventer 100. A passage 118 is provided in body 114 leading to bore 116 for directing sealant into the bore and pipe 120 leading to a sealant supply, such as shown in FIG. 5, is connected to spool 110 to place passage 118 in communication with conduits 84. Further, a valve means may be provided in pipe 120 to prevent fluids from flowing out through sealant passage 118 as explained for the embodiment shown in FIG. 3 or, preferably, a check valve similar to that shown in FIG. 4 is disposed within each passage 118. In this embodiment, the occurence of a blowout in the well is sensed, the clamping means close to keep the fluid pressure within the bore hole and the sealant is injected through passage 118 in spool 110 to be carried by leaking fluids up bore 116 and 104 to clamping means 106 for forming a seal to insure the fluids do not leak out of the well.

From the foregoing it will be seen that this invention is one well adapted to attain all of the ends and objects hereinabove set forth, together with other advantages which are obvious and which are inherent to the apparatus and method.

It will be understood that certain features and sub-combinations are of utility and may be employed with reference to other features and sub-combinations. This is contemplated by and is within the scope of the claims.

As many possible embodiments may be made of the invention without departing from the scope thereof, it is to be understood that all matter herein set forth or shown in the accompanying drawings are to be interpreted as illustrative and not in a limiting sense.

I claim:

1. A method of insuring the prevention of fluid leaks out of a wellhead, comprising the steps of:

installing a blowout preventer at the wellhead, said blowout preventer having a body with a bore for communicating with the bore hole of a well, clamping means mounted with the body for controlling the passage of fluid through the bore, and means mounted with the body for directing sealant into the bore above the wellhead and below the clamping means, said directing means including sealant passageways communicating with the bore, the passageways being disposed within the body with outlets below and above the clamping means to insure that the sealant is directed below the clamping means when injected through the passageways even though the blowout preventer is installed upside down on the wellhead;

sensing the occurrence of of a blowout in the well;

closing the clamping means to inhibit the flow of fluid up the bore; and injecting a sealant through the sealant directing means into the bore so that the sealant is carried to the closed clamping means by flowing fluids, a seal being formed thereby to insure that the fluids do not back past the closed clamping means.

2. A method of insuring the prevention of fluid leaks out of a well, comprising the steps of:

installing a blowout preventer at the wellhead, said blowout preventer having a body with a bore for communicating with the bore hole of a well, clamping means mounted with the body for keeping the fluid pressure within the bore hole, sealant directing means at the wellhead for directing sealant into the bore below the clamping means and sealant passage means in said body with outlets below and above said clamping means;

sensing the occurrence of a blowout in the well;

closing the clamping means in response to the sensed occurrence to seal the fluid pressure within the well; and injecting a sealant through the sealant directing means into the bore so that the sealant will be carried to the closed clamping means by any fluids leaking past the closed clamping means, a seal being formed by such sealant at said clamping means to insure that fluids do not leak out of the well.

3. A method of insuring the prevention of fluid leaks out of a wellhead, comprising the steps of:

installing a spool at the wellhead, said spool having a body with a bore for communicating with the bore hole of a well and means mounted with the spool body for directing sealant into the bore above the wellhead;

installing a blowout preventer above said spool at the wellhead, said blowout preventer having a body with a bore for communicating with the bore hole of the well and clamping means mounted with the preventer body for controlling the passage of fluid through the bore said blowout preventer having an internal packing in the annulus between said bore and the pipe extending through said bore, said packing being located below said clamping means and above said sealant directing means;

sensing the occurrence of a blowout in the well;

closing the clamping means in response to the sensed occurrence to inhibit the flow of fluid up the bore; and injecting a sealant through the sealant directing means into the bore so that the sealant is carried through said internal packing to the closed clamping means by flowing fluids, a seal being formed thereby to insure the fluids do not leak past the closed clamping means.

4. A ram-type blowout preventer used at a wellhead, comprising:

a body with a bore therethrough;

means mounted with said body for coupling said body to the wellhead with the bore in communication with a borehole;

clamping means mounted with said body for controlling the passage of fluids through the bore by moving from an opened position where said clamping means is retracted to a closed position where said clamping means is in clamping and sealing engagement with drill pipe extending through said bore;

said clamping means being carried by opposing rams; and means mounted with said body for directing sealant into the bore above the wellhead and below said clamping means, said directing means including four sealant passages provided in said body leading to the bore with outlets from each passage located above the wellhead and below the clamping means, the outlet of each passage being on either side of and in relatively close proximity to each opposing ram to provide uniform distribution of sealant around the bore, a sealant injected into said directing means being carried by fluid flowing up the bore to the clamping means and cooperating with said clamping means to enhance the sealing ability of said clamping means when the clamping means are closed and thereby insure that fluid does not leak past the clamping means.

5. A blowout preventer used at a wellhead, comprising:

a body with a bore therethrough;

means mounted with said body for coupling said body to the wellhead with the bore in communication with a borehole;

clamping means mounted with said body for controlling the passge of fluids through the bore by moving from an opened position where said clamping means is retracted to a closed position where said clamping means is in clamping and sealing engagement with pipe extending through said bore;

means mounted with said body for directing sealant into the bore above the wellhead and below said clamping means; and valve means mounted with said directing means for preventing fluid flow out of the bore while permitting fluid flow into the bore, a sealant being injected through said directing means being carried by fluid flowing up the bore to the clamping means which sealant cooperates with said clamping means to enhance the sealing ability of said clamping means when the clamping means are closed, thereby insuring that fluid does not leak past the closed clamping means.

6. The blowout preventer of claim 5, wherein said directing means includes a passage provided in the body leading to the bore and said valve means includes a seating surface disposed within the passage, a movable element mounted within the passage for mating with the seating surface and a spring urging the element into engagement with the seating surface.

7. The blowout preventer of claim 6, including a bolt threadedly mounted in the passage for plugging the passage to prevent flow of fluid and sealant through the passage.

8. The blowout preventer of claim 7, including a cap covering the passage for preventing fluid flow out of the bore through the passage to the seating surface.

9. The blowout preventer of claim 6, including a cap covering the passage for preventing fluid flow out of the bore through the passage to the seating surface.

10. A blowout preventer used at a wellhead, comprising:

a body with a bore therethrough;

means mounted with said body for coupling said body to the wellhead with the bore in communication with a borehole;

clamping means mounted with said body for controlling the passage of fluids through the bore by moving from an opened to a closed position; and means mounted with said body for directing sealant into the bore above the wellhead and below said clamping means, said directing means including a sealant passage provided in the body leading to the bore with outlets located above and below said clamping means to insure that sealant injected through said passage will be injected on the wellhead side of said clamping means and carried by fluid flowing up the bore to form a seal when the clamping means are closed which insures that fluid does not leak past the closed clamping means even though the blowout preventer is installed upside down at the wellhead.

11. An opposing ram-type blowout preventer used at a wellhead, comprising:

a body with a bore therethrough;

means mounted with said body for coupling said body to the wellhead with the bore in communication with a borehole;

clamping means mounted with said body for controlling the passage of fluids through the bore by moving from an opened to a closed position, said clamping means being carried by opposing rams;

means mounted with said body for directing sealant into the bore above the wellhead and below said clamping means, said directing means including a set of four sealant passages provided in the body leading to the bore with outlets located below said clamping means and another set of four sealant passages provided in the body leading to the bore with outlets located above said clamping means to insure the injection of sealant on the wellhead side of said clamping means in the event the blowout preventer is installed upside down on the wellhead, an outlet of each passageway of each set of four being on either side of and in relatively close proximity to each opposing ram to provide a uniform flow of sealant around the bore; and valve means mounted within each passage for preventing fluid flow out of the bore while permitting fluid flow into the bore, a sealant being injected through said directing means being carried by fluid flowing up the bore to the clamping means which forms a seal when the clamp-means are closed and thereby insure that fluid will not leak past the closed clamping means.

12. The blowout preventer of claim 11, wherein said valve means includes a seating surface disposed within each passage, a movable element mounted within the passage for mating with the seating surface and a spring urging the element into engagement with the seating surface.

13. A blowout preventer used at a wellhead, comprising:

a body with a bore therethrough; means mounted with said body for coupling said body to the wellhead with the bore in communication with a borehole;

clamping means mounted with said body for clamping against pipe extending through said bore and controlling the passage of fluids through the bore by moving from an opened position where said clamping means is retracted to a closed position where said clamping means is in clamping and sealing engagement with said pipe;

means mounted with said body for directing sealant into the bore above the wellhead and below said clamping means, a sealant injected through said directing means is carried by fluid flowing up the bore to the clamping means and enhances the seal of said clamping means when the clamping means are closed and thereby insures that fluid does not leak past the closed clamping means.

14. The blowout preventer of claim 13, wherein said clamping means includes opposing rams to thereby form a ram-type blowout preventer.

15. The blowout preventer of claim 13, including sealant supply means mounted with said body for injecting the sealant through said directing means into the bore of the blowout preventer.

16. The blowout preventer of claim 15, including control means mounted with said supply means for injecting the sealant into said directing means from a remote location.

17. The blowout preventer of claim 13, wherein said clamping means includes annular packing members to thereby form an annular type blowout preventer.

18. A wellhead assembly for insuring the prevention of leaks out of a well, comprising:

a blowout preventer for sealing the fluid pressure within a borehole of the well, said preventer including a body with a bore in communication with the borehole and clamping means mounted with the body for sealing the fluid pressure within the borehole when a blowout is sensed; and means mounted in said body beneath said clamping means of said blowout preventer for directing sealant into the bore of said blowout preventer below said clamping means when the clamping means move to a closed position to seal the fluid pressure within the borehole, the sealant being carried by leaking fluids up to the bore to the closed clamping means and cooperating with said clamping means to enhance the seal of said clamping means to insure that the fluids do not leak out of the well.

19. The wellhead assembly of claim 18, wherein said directing means includes a casing spool mounted with the casing in the well, said spool having a body with a bore in communication with the borehole and the bore of said blowout preventer and a passage in communication with the bore for directing sealant into the bore to be carried by the fluids up to the clamping means of said blowout preventer.

20. A wellhead assembly for insuring the prevention of leaks out of a well, comprising:

a blowout preventer for sealing the fluid pressure within a borehole of the well, said preventer including a body with a bore in communication with the borehole and clamping means mounted with the body for sealing the fluid pressure within the borehole when a blowout is sensed; and means mounted beneath said blowout preventer for directing sealant into the bore of said blowout preventer when the clamping means move to a closed position to seal the fluid pressure within the borehole, the sealant being carried by leaking fluids up the bore to closed clamping means which forms a seal to insure that the fluids do not leak out of the well, said directing means including a casing spool mounted with the casing on the well, said spool having a body with a bore in communication with the borehole and the bore of said blowout preventer and a passage in communication with the bore for directing sealing into the bore to be carried by the fluids up to the clamping means of said blowout preventer; and valve means mounted with said spool for preventing fluid flow-out of the bore while permitting fluid flow into the bore.

21. The blowout preventer of claim 20, wherein said directing means includes a passage provided in the body leading to the bore and said valve means includes a seating surface disposed within the passage, a movable element mounted within the passage for mating with the seating surface and a spring urging the element into engagement with the seating surface.

22. The blowout preventer of claim 21, including a bolt threadedly mounted in the passage for plugging the passage to prevent flow of fluid and sealant through the passage.

23. The blowout preventer of claim 22, including a cap covering the passage for preventing fluid flow out of the bore through the passage to the seating surface.

24. The blowout preventer of claim 21, including a cap covering the passage for preventing fluid flow out of the bore through the passage to the seating surface.

25. A casing spool used in a wellhead assembly, comprising:

a body with a bore therethrough;

means mounted with said body for attaching said body beneath a blowout preventer in the wellhead assembly, the bore being in communication with the borehole of a well and a bore in the blowout preventer;

means defining a passage in said body leading to the bore for directing a sealant into the bore, the sealant being carried by leading fluids up the bore to closed clamping means in the blowout preventer for forming a seal to insure that the fluids do not leak out of the well; and valve means mounted with said body for preventing fluid flow out of the bore while permitting sealant flow into the bore.

26. The casing spool of claim 25, wherein said directing means includes means defining a passage provided in the body leading to the bore and said valve means includes a seating surface disposed within the passage, a movable element mounted within the passage for mating with the seating surface and a spring urging the element into engagement with the seating surface.

27. The casing spool of claim 26 including a bolt threadedly mounted in the passage for plugging the passage to prevent flow of fluid and sealant through the passage.

28. The casing spool of claim 27, including a cap covering the passage for preventing fluid flow out of the bore through the passage to the sealing surface.

29. The casing spool of claim 25, including a cap covering the passage for preventing fluid flow out of the bore through the passage to the seating surface.

* * * * *